United States Patent [19]

Landfried et al.

[11] 4,183,569

[45] Jan. 15, 1980

[54] ANTI-THEFT DOOR LOCK

[76] Inventors: Dennis C. Landfried, 135 Beachwood Ave., Avon Lake, Ohio 44012; Raymond W. Busony, 1341 Thoreau, Lakewood, Ohio 44107

[21] Appl. No.: 832,443

[22] Filed: Sep. 12, 1977

[51] Int. Cl.[2] ..... E05C 13/02

[52] U.S. Cl. ..... 292/347

[58] Field of Search ..... 292/1, 336.3, 347; 70/181

[56] References Cited

U.S. PATENT DOCUMENTS

| | | | |
|---|---|---|---|
| 3,247,691 | 4/1966 | Martin | 292/1 |
| 3,501,187 | 3/1970 | Saksa et al. | 292/1 |
| 3,623,758 | 11/1971 | Trinca | 70/181 |
| 3,838,876 | 10/1974 | Haven | 292/336.3 |
| 3,999,788 | 12/1976 | Livingston | 292/347 |

*Primary Examiner*—Richard E. Moore
*Attorney, Agent, or Firm*—Gustalo Nunez

[57] ABSTRACT

An anti-theft door lock comprised generally of two sections, an outer spring loaded section and an inner section connected to the door locking mechanism in which the outer section is pushed downwardly exposing the inner section which can then be manipulated like a conventional door lock to either lock or unlock the car door.

The anti-theft device is used as a replacement unit for the one originally supplied with the vehicle. It can be placed in the door sill without the need of any tools and is designed to be screwed onto the existing locking rod which actuates the door lock. Because of the inherent design features, the door lock cannot be actuated by the use of wire type devices, such as coat hangers by would-be car thieves.

2 Claims, 4 Drawing Figures

ANTI-THEFT DOOR LOCK

BACKGROUND OF THE INVENTION

1. Field of the Invention

This invention is directed to locks for use in automobile doors. The locking mechanism is formed basically from two sections in which the outer section is spring loaded and is free to go up or down and which will also always be in the up position because of the spring load when not being pushed down by the operator. Inside the outer section is the conventional door locking button which is exposed to the user when the first section is pushed downwardly.

When the first section is downward, the locking mechanism can be operated just like any other door lock. This type of construction prevents a thief from using a wire device to release the lock as can be done now with conventional door locks. Thus, the would-be thief would be frustrated since he could not push the first section downwardly while simultaneously pulling up the door locking mechanism. It can be seen that the major object of the invention is to provide a simple inexpensive locking mechanism for a car which cannot be operated on by the use of wire devices. Further, the simplicity of this invention makes it economical to manufacture and easy to install.

2. Description of the Prior Art

The prior art is replete with inventions directed to jimmyproof automobile door locks, however, they all utilize a tool or key for unlocking the door which would frustrate car owners from using the same. Below are some of the patents which are representative of the activity directed to automobile anti-theft devices.

U.S. Pat. No. 2,708,845 to Trammell Jr., (CL-70-181) discloses a lock plunger guarding device which requires a tool in the operation thereof.

U.S. Pat. No. 2,814,197 to Probala et al, (CL-70-181) discloses a lock control device which requires a key in the operation thereof.

U.S. Pat. No. 2,735,289 to Trammell Jr., (CL-70-181) discloses a mechanically complex guard assembly for door locks which also requires a key or tool to operate.

U.S. Pat. No. 2,855,773 to Evans (CL-70-181) discloses an anti-theft device which requires no tools or key to operate. Evans discloses a structure which is mechanically complex and which to operate requires rotation of the locking button. Evans solves the problem in a most difficult manner.

U.S. Pat. No. 3,860,278 to Dalia (CL-292-347) discloses a locking button which is flush with the door panel which by its inherent design would make it difficult to upll open with one's fingers to unlock.

U.S. Pat. No. 3,915,485 to Richman, et al (CL-292-1) also discloses a locking button which utilizes the teaching of Dalia in that the button is flush with a glued on surface having a concavity therein for mating with the locking button.

It can be seen that there is no teaching of a device such as that discloses by the applicants, which utilizes a spring loaded telescoping outside shield for guarding the locking button of an automobile door lock.

SUMMARY OF THE INVENTION

Objectives of the invention include providing an automobile door lock button having features which prevent its being actuated by wire type instruments, such as coat hangers, which are inserted in a car through the window and operating the locking button to unlock the car. The present invention has these features and is simple to install, i.e., simply remove the old locking button and screw in its place the Anti-Theft Door Lock button contemplacted by the present invention.

The locking button is comprised generally of three components, an outer telescopic shield, a helical spring inserted over an inner button which is connected to the door locking mechanism screw rod. In the unlocked position, the inner button would be flush with the outside shield. When locking the car, pressing the button down would also cause the outside shield to go down simultaneously, when the door button is in the lock position, releasing the button results in the outside shielf going to its up position by the force exerted by the spring load. When in the up position, the only manner in which the locking button can be manipulated would be for one to push the outside shield down, thus exposing the locking button, which can then be pulled up to the unlock position.

DESCRIPTION OF THE PREFERRED EMBODIMENT

Figure 4:
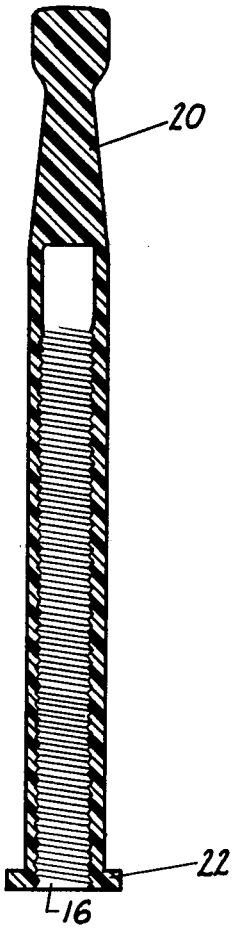
FIG. 4 is a section view of the inner locking button.
Figure 3:
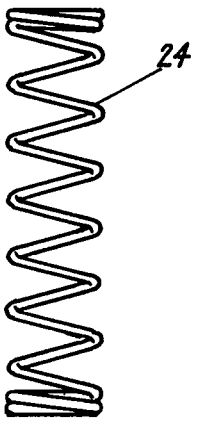
FIG. 3 is a view of the helical spring.
Figure 2:
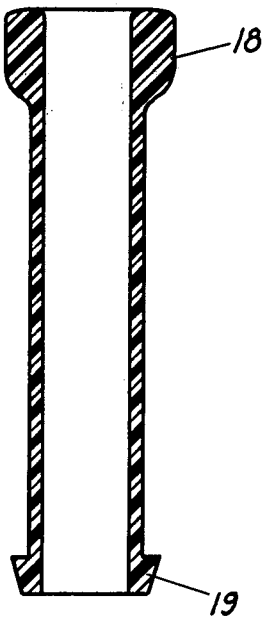
FIG. 2 is a sectional view of the outer shield.
Figure 1:
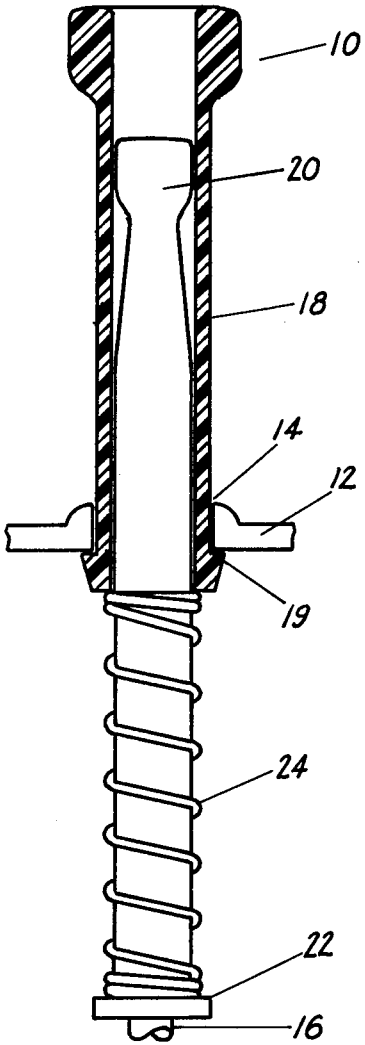
FIG. 1 is a view of the Anti-Theft Door Lock generally.

Referring to FIG. 1, the anti-theft locking device can be seen generally at 10. The door sill is shown at 12 having therein an opening at 14. Within the door panel along with the standard devices such as window openers, etc., is a rod 16 which actuates the door locking mechanism (not shown). The upper portion of the rod 16 is threaded (not shown) about which is screwed the anti-theft locking assembly.

The locking device 10 is comprised of an elongated cylindrical body 18 having an inner opening therein for receiving the locking actuating button 20 and a flared button base 19. The lock actuating button has an elongated threaded cavity therein for engaging the threads on the upper portion of the locking rod 16. Also made a part of the button 20 is a spring clamp seat 22 which may be circular in shape and a spring 24 which is positioned between the spring clamp 22 and the flared base 19 of the outside member 18 such that the resiliency of the spring 24 shall keep the top portion of member 18 in an up position.

In actual practice the locking device 10 comes as a completely fabricated unit with the installation being the only step required for the actual use thereof. The entire locking device can be formed from plastic type materials having a degree of resiliency such that when the device 10 is installed, the bottom portion 19 can be compressed to allow entry of the locking device 10 into the door sill opening 14.

To install the Anti-Theft Door Lock, the actuator button 20 is inserted through the opening 14 and screwed onto the threads of locking rod 16. The spring 24 is then placed over the actuator button 20, resting on the spring clamp seat 22. The outer shield 10 is then placed over the actuator button 20 and pushed through the opening 14. The outer shield 20 is held upwardly by the spring 24. The installation process requires no tools of any kind.

In operation, when one wants to lock the door by use of the device 10, it can be done just as one would do with a conventional door lock i.e., simply bu phusing down on the actuator button 20 which would also result in the member 18 being depressed, however, once the locking mechanism is engaged, it will remain in position and member 18 will be pushed upward because of the spring load. It can be seen that a would-be thief could not pull the actuator button upwardly because of the protection offered by member 18. The thief would have to somehow push member 18 down and actuator button 20 upwardly, an impossible feat to accomplish with a wire device such as a coat hanger.

To unlock the device 10, the authorized person would simply depress member 18 with his thumb and forefinger and with the same thumb and forefinger grab the actuator button 20 and pull it upwardly, thus placing it in an unlock position.

We claim:

1. In combination with an automobile door lock and an anti-thief locking device that actuates a conventional automobile door locking rod in a downward direction for locking and an upward direction for unlocking, comprising:

an elongated first member having a bore therein from one end to the other end, said first member structurally adapted to be inserted into the automobile door lock opening located on a conventional door sill;

an elongated second member having a threaded bore at one end for threadingly engaging said automobile locking rod;

resilient spring means positioned about said second member, and retained thereon by spring retaining means; said spring further being in contact with the bottom portion of said first member, such that when said first and second members are actuated in a downward movement, the locking rod will become engaged and upon release of said second member, said first member will be moved in an upward direction by said spring means thereby shielding said second member said first member being held in position by said spring means against the bottom portion of said door sill.

2. In combination with an automobile door lock and an anti-theft locking button that actuates an upwardly extending locking rod having a threaded end that is aligned with an opening located on a door sill, comprising:

an elongated tubular first member positioned through said sill opening, having a bore from one end to the other end and an outwardly extending flat surface, for securing said first member against the door sill;

a second elongated tubular member having a threaded bore and an outwardly extending flat surface at one end, said second member being axially movable within said first member and adapted to threadingly engage said locking rod, a helical spring adapted to pass over the second member and engage said flat surfaces of said first and second members such that said first member is forcibly held by said spring against the door sill, such that when first and second members are actuated in a downward movement the locking rod will be engaged and upon the release of said actuating force, said first member will be moved in an upward direction by said spring thereby shielding said second member.

* * * * *